US009726425B2

(12) United States Patent
Kevenaar et al.

(10) Patent No.: US 9,726,425 B2
(45) Date of Patent: Aug. 8, 2017

(54) METHOD AND APPARATUS FOR LIQUEFYING A NATURAL GAS STREAM

(75) Inventors: Mark Antonius Kevenaar, The Hague (NL); Chun Kit Poh, The Hague (NL)

(73) Assignee: SHELL OIL COMPANY, Houston, TX (US)

( * ) Notice: Subject to any disclaimer, the term of this patent is extended or adjusted under 35 U.S.C. 154(b) by 2725 days.

(21) Appl. No.: 12/296,587

(22) PCT Filed: Apr. 10, 2007

(86) PCT No.: PCT/EP2007/053448

§ 371 (c)(1),
(2), (4) Date: Oct. 9, 2008

(87) PCT Pub. No.: WO2007/116050

PCT Pub. Date: Oct. 18, 2007

(65) Prior Publication Data

US 2009/0277218 A1 Nov. 12, 2009

(30) Foreign Application Priority Data

Apr. 12, 2006 (EP) ..... 06112511

(51) Int. Cl.
*F25J 1/00* (2006.01)
*F25J 3/00* (2006.01)
(Continued)

(52) U.S. Cl.
CPC ..... *F25J 1/0052* (2013.01); *F25J 1/0022* (2013.01); *F25J 1/0035* (2013.01); *F25J 1/0045* (2013.01);
(Continued)

(58) Field of Classification Search
USPC ..... 62/606, 611, 612, 613, 614, 617
See application file for complete search history.

(56) References Cited

U.S. PATENT DOCUMENTS 4,689,063 A * 8/1987 Paradowski et al. ..... 62/627
4,690,702 A 9/1987 Paradowski et al. ..... 623/23
(Continued)

FOREIGN PATENT DOCUMENTS

WO WO2005045338 5/2005 ..... F25J 3/02

OTHER PUBLICATIONS

Hagyard, Philip, et al.: Simultaneous Production of LNG and NGL, Process & Technology Division and slides presented at meeting, Technip, Cedex, France. Pascale Morin & Jean-Claude Garcel, Exploration & Production, Total, Cedex, France. LNG 14 meeting in Qatar, Mar. 21-24, 2004. (www.lng14.com.qa).

*Primary Examiner* — Henry Crenshaw

(57) ABSTRACT

The present invention relates to a method of liquefying a hydrocarbon stream such as a natural gas stream, the method at least comprising the steps of: supplying a partly condensed hydrocarbon feed stream (10) to a first gas/liquid separator (2); separating the feed stream (10) in the first gas/liquid separator (2) into a gaseous stream (20) and a liquid stream (30); expanding the gaseous stream (20) thereby obtaining an expanded stream (40) and feeding it (40) into a second gas/liquid separator (3); feeding the liquid stream (30) into the second gas/liquid separator (3); removing from the bottom of the second gas/liquid separator a liquid stream (60) and feeding it into a fractionation column (5); removing from the top of the second gas/liquid separator (3) a gaseous stream (50) and passing it to a compressor (6) thereby obtaining a compressed stream (70); cooling the compressed stream (70) thereby obtaining a cooled compressed stream (80); heat exchanging the cooled compressed stream (80) against a stream being downstream of the first gas/liquid separator (2) and upstream of the fractionation column (5).

14 Claims, 2 Drawing Sheets

(51) Int. Cl.
*F25J 1/02* (2006.01)
*F25J 3/02* (2006.01)

(52) U.S. Cl.
CPC ..... *F25J 1/0087* (2013.01); *F25J 1/0237* (2013.01); *F25J 3/0209* (2013.01); *F25J 3/0233* (2013.01); *F25J 3/0238* (2013.01); *F25J 3/0242* (2013.01); *F25J 2200/04* (2013.01); *F25J 2200/74* (2013.01); *F25J 2200/78* (2013.01); *F25J 2205/04* (2013.01); *F25J 2215/62* (2013.01); *F25J 2235/60* (2013.01); *F25J 2240/02* (2013.01); *F25J 2260/20* (2013.01); *F25J 2270/02* (2013.01); *F25J 2270/04* (2013.01); *F25J 2270/12* (2013.01); *F25J 2270/60* (2013.01)

(56) References Cited

U.S. PATENT DOCUMENTS

| | | | | | |
|---|---|---|---|---|---|
| 5,146,756 | A * | 9/1992 | Lavin | ..... | 62/646 |
| 5,291,736 | A | 3/1994 | Paradowski | ..... | 62/20 |
| 5,890,378 | A * | 4/1999 | Rambo et al. | ..... | 62/621 |
| 6,116,050 | A | 9/2000 | Yao et al. | ..... | 62/630 |
| 6,182,469 | B1 * | 2/2001 | Campbell et al. | ..... | 62/621 |
| 6,363,744 | B2 * | 4/2002 | Finn et al. | ..... | 62/621 |
| 6,401,486 | B1 | 6/2002 | Lee et al. | ..... | 62/630 |
| 6,526,777 | B1 * | 3/2003 | Campbell et al. | ..... | 62/621 |
| 6,923,051 | B2 | 8/2005 | Fleming | ..... | 73/147 |
| 7,210,311 | B2 * | 5/2007 | Wilkinson | ..... | 62/611 |
| 2003/0005722 | A1 * | 1/2003 | Wilkinson et al. | ..... | 62/613 |
| 2004/0244415 | A1 * | 12/2004 | Paradowski | ..... | 62/612 |
| 2005/0204774 | A1 * | 9/2005 | Foglietta et al. | ..... | 62/620 |
| 2005/0247078 | A1 * | 11/2005 | Wilkinson et al. | ..... | 62/612 |

* cited by examiner

METHOD AND APPARATUS FOR LIQUEFYING A NATURAL GAS STREAM

The present application claims priority from European Patent Application 06112511.8 filed 12 Apr. 2006.

FIELD OF THE INVENTION

The present invention relates to a method of liquefying a hydrocarbon stream such as a natural gas stream.

BACKGROUND OF THE INVENTION

Several methods of liquefying a natural gas stream thereby obtaining liquefied natural gas (LNG) are known.

It is desirable to liquefy a natural gas stream for a number of reasons. As an example, natural gas can be stored and transported over long distances more readily as a liquid than in gaseous form, because it occupies a smaller volume and does not need to be stored at high pressures.

Usually, the natural gas stream to be liquefied (mainly comprising methane) contains ethane, heavier hydrocarbons and possibly other components that are to be removed to a certain extent before the natural gas is liquefied. To this end, the natural gas stream is treated. One of the treatments involves the removal of at least some of the ethane, propane and higher hydrocarbons such as butane and propanes (often referred to with "NGL extraction" or "NGL recovery").

U.S. Pat. No. 5,291,736 discloses a known method of liquefaction of natural gas including the removal of hydrocarbons heavier than methane. Another example of a known method is given in US 2005/0247078.

A problem of the known methods is that if a relatively lean feed stream (i.e. containing relatively little ethane, propane and other hydrocarbons) is to be processed, no optimal use is made of the available cooling capacity. In other words, less LNG is produced using the same cooling duty.

SUMMARY OF THE INVENTION

It is an object of the invention to minimize the above problem.

It is a further object of the present invention to provide an alternative method for liquefying a natural gas stream, at the same time recovering some of the ethane, propane and higher hydrocarbons in the feed stream.

One or more of the above or other objects are achieved according to the present invention by providing a method of liquefying a hydrocarbon stream such as a natural gas stream, the method at least comprising the steps of:

(a) supplying a partly condensed hydrocarbon feed stream to a first gas/liquid separator;

(b) separating the feed stream in the first gas/liquid separator into a gaseous stream and a liquid stream;

(c) expanding the gaseous stream obtained in step (b) thereby obtaining an expanded stream and feeding it into a second gas/liquid separator at a first feeding point;

(d) feeding the liquid stream obtained in step (b) into the second gas/liquid separator at a second feeding point;

(e) removing from the bottom of the second gas/liquid separator a liquid stream and feeding it into a fractionation column;

(f) removing from the top of the second gas/liquid separator a gaseous stream and passing it to a compressor thereby obtaining a compressed stream having a pressure above 50 bar;

(g) cooling the compressed stream obtained in step (f) thereby obtaining a cooled compressed stream;

(h) heat exchanging the cooled compressed stream obtained in step (g) against a stream being downstream of the first gas/liquid separator and upstream of the fractionation column; and (i) liquefying the cooled compressed stream, after heat exchanging in step (h), thereby obtaining a liquefied stream.

BRIEF DESCRIPTION OF THE DRAWINGS

Hereinafter the invention will be further illustrated by the following non-limiting drawing. Herein shows.

DETAILED DESCRIPTION OF THE INVENTION

Figure 1:
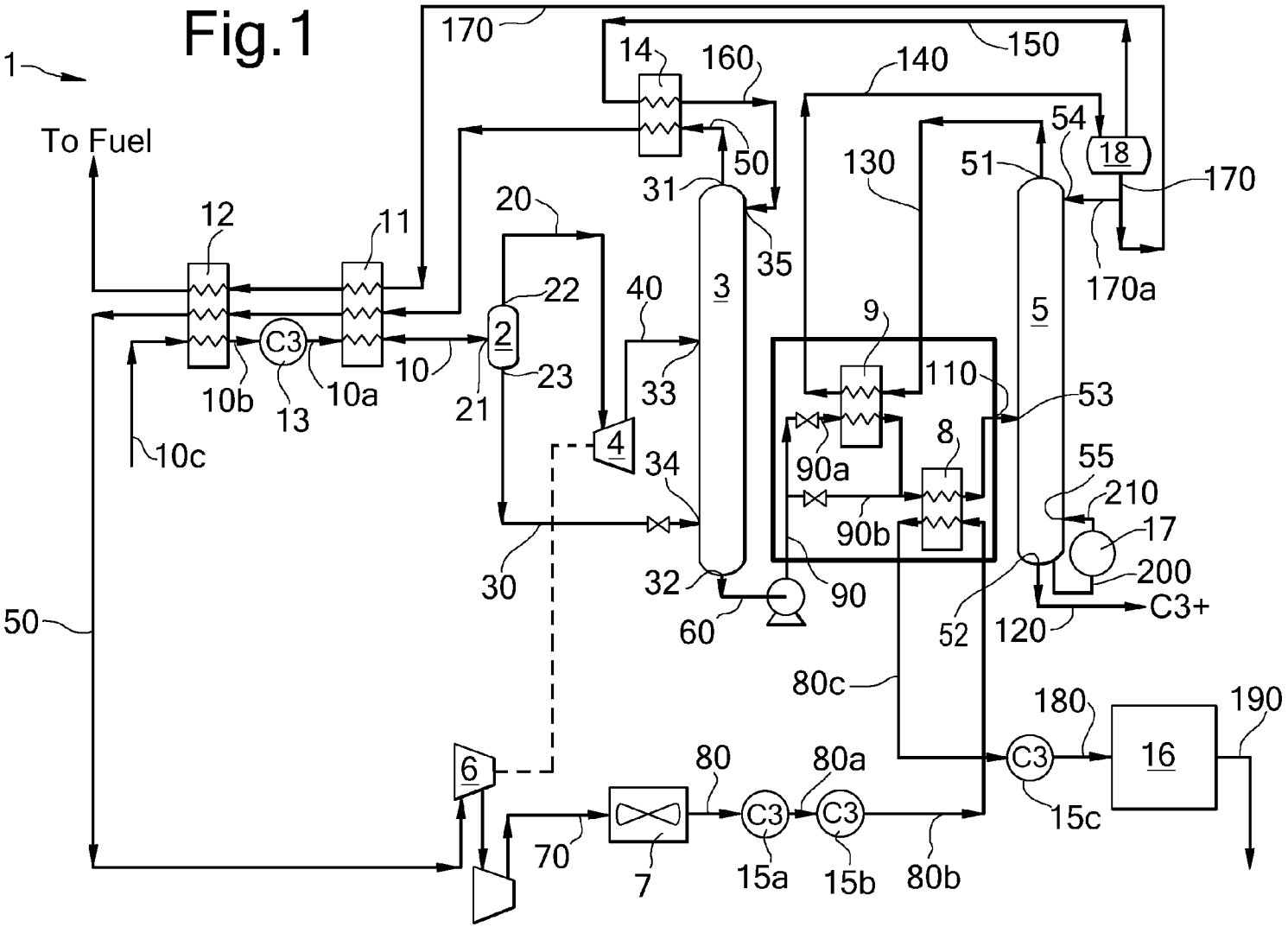
FIG. 1 schematically a process scheme in accordance with the present invention.

It has been surprisingly found that according to the present invention the LNG production can be increased while using the same available external cooling duty.

An additional advantage of the present invention is that the method is relatively simple thereby resulting in lower CAPEX (Capital Expenses).

It is noted in this respect that U.S. Pat. No. 4,689,063 and No. 6,116,050 suggest to heat exchange several streams against this other. However, U.S. Pat. No. 4,689,063 and No. 6,116,050 are not aimed at liquefaction of a (usually methane-enriched) hydrocarbon stream and as a result do not teach to provide a high pressure stream of at least 50 bar (as is the case in step (f) of the method according to the present invention). Further, as U.S. Pat. No. 4,689,063 and No. 6,116,050 are not aimed at liquefaction, efficiency considerations as made in these two publications (and optional other similar publications) are not automatically valid for line-ups which do aim at the liquefaction of a (usually methane-enriched) hydrocarbon stream.

According to the present invention, the hydrocarbon stream may be any suitable hydrocarbon-containing stream to be liquefied, but is usually a natural gas stream obtained from natural gas or petroleum reservoirs. As an alternative the natural gas stream may also be obtained from another source, also including a synthetic source such as a Fischer-Tropsch process.

Usually the natural gas stream is comprised substantially of methane. Preferably the feed stream comprises at least 60 mol % methane, more preferably at least 80 mol % methane.

Depending on the source, the natural gas may contain varying amounts of hydrocarbons heavier than methane such as ethane, propane, butanes and pentanes as well as some aromatic hydrocarbons. The natural gas stream may also contain non-hydrocarbons such as $H_2O$, $N_2$, $CO_2$, $H_2S$ and other sulphur compounds, and the like.

If desired, the feed stream may be pre-treated before supplying it to the first gas/liquid separator. This pre-treatment may comprise removal of undesired components such as $CO_2$ and $H_2S$, or other steps such as pre-cooling, pre-pressurizing or the like. As these steps are well known to the person skilled in the art, they are not further discussed here.

The first and second gas/liquid separators may be any suitable means for obtaining a gaseous stream and a liquid stream, such as a scrubber, fractionation column, distillation column, etc. If desired, two or more parallel first gas/liquid separators may be present. Preferably, the second gas/liquid separator is a column such as a distillation column.

Also, the person skilled in the art will understand that steps of expanding, cooling and heat exchanging may be performed in various ways. As the person skilled readily understands how to apply these steps, this is not further discussed here.

Further the person skilled in the art will readily understand that the streams obtained may be further processed, if desired.

Also, the cooled compressed stream obtained in step (h) after heat exchanging will be liquefied thereby obtaining a liquefied stream such as LNG. This liquefaction may be performed in various ways. Also, further intermediate processing steps between the gas/liquid separation in the first gas/liquid separator and the liquefaction may be performed.

Preferably, in step (h) direct heat exchange takes place, i.e. wherein the two (or more) streams to be heat exchanged are passed against each other (co- or counter-currently) in at least one common heat exchanger. Thus, e.g. the use of e.g. an intermediate heat transfer fluid (as used in e.g. US 2005/0247078) can be avoided.

Further it is preferred that in step (h) the cooled compressed stream is heat exchanged against the liquid stream removed in step e) from the second gas/liquid separator.

Herewith the load on the refrigerant used (e.g. in a propane cooling cycle) for the cooling of the cooled compressed stream is reduced such that the production of liquefied stream can be increased.

Further it is preferred that in step (h) the cooled compressed stream is heat exchanged against at least a part of the expanded stream obtained in step c).

Herewith the load on the refrigerant used (e.g. in a propane cooling cycle) for the cooling of the cooled compressed stream can be further reduced.

Advantageously, from the top of the fractionation column a gaseous stream is removed that is heat exchanged against at least a part of the bottom stream from the second gas/liquid separator.

Further it is preferred that the gaseous stream removed in step f) from the top of the second gas/liquid separator is heat exchanged against the feed stream, before it is fed to the compressor.

Also it is preferred that the gaseous stream removed from the fractionation column, after heat exchanging against at least a part of the bottom stream from the second gas/liquid separator, is heat exchanged against the gaseous stream removed from the second gas/liquid separator.

In an even further aspect the present invention provides an apparatus suitable for performing the method according to the present invention, the apparatus at least comprising:

- a first gas/liquid separator having an inlet for a partly condensed hydrocarbon feed stream, a first outlet for a gaseous stream and a second outlet for a liquid stream;
- a second gas/liquid separator having at least a first outlet for a gaseous stream and a second outlet for a liquid stream and first and second feeding points;
- an expander for expanding the gaseous stream obtained from the first outlet of the first gas/liquid separator, thereby obtaining an expanded stream;
- a fractionation column having at least a first outlet for a gaseous stream and a second outlet for a liquid stream and a first feeding point;
- a compressor for compressing the gaseous stream removed from the first outlet of the second gas/liquid separator thereby obtaining a compressed stream having a pressure above 50 bar;
- a cooler for cooling the compressed stream obtained from the compressor thereby obtaining a cooled compressed stream;
- a first heat exchanger for heat exchanging the cooled compressed stream against a stream being downstream of the first gas/liquid separator and upstream of the fractionation column; and
- a liquefaction unit for liquefying the cooled compressed stream, downstream of the first heat exchanger, the liquefaction unit comprising at least one cryogenic heat exchanger.

Figure 2:
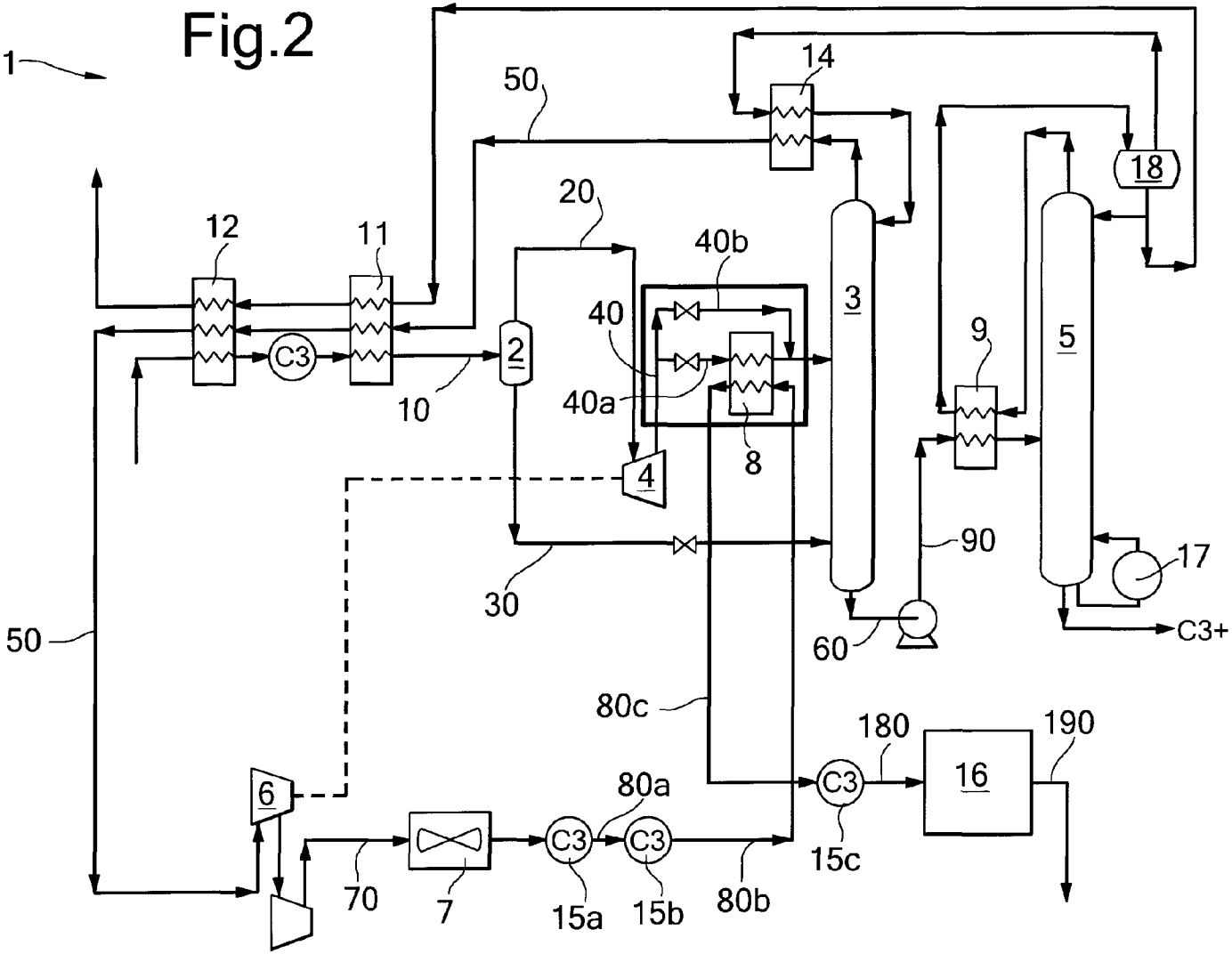
FIG. 2 schematically a process scheme in accordance with another embodiment of the present invention.

Hereinafter the invention will be further illustrated by the following non-limiting drawing. Herein shows:

FIG. 1 schematically a process scheme in accordance with the present invention; and FIG. 2 schematically a process scheme in accordance with another embodiment of the present invention.

For the purpose of this description, a single reference number will be assigned to a line as well as a stream carried in that line. Same reference numbers refer to similar components.

FIG. 1 schematically shows a process scheme (generally indicated with reference no. 1) for the liquefaction of a hydrocarbon stream such as natural gas in which ethane and heavier hydrocarbons are removed ("NGL recovery") to a certain extent before the actual liquefaction takes place.

The process scheme of FIG. 1 comprises a first gas/liquid separator 2, a second gas/liquid separator 3 (in the embodiment of FIGS. 1 and 2 a distillation column such as an absorber column), an expander 4, a fractionation column 5, a compressor 6 (that may be a train containing one or more compressors), a cooler 7, a first heat exchanger 8, a second heat exchanger 9, a third heat exchanger 11 and a liquefaction unit 16. The person skilled in the art will readily understand that further elements may be present if desired.

During use, a partly condensed feed stream 10 containing natural gas is supplied to the inlet 21 of the first gas/liquid separator 2 at a certain inlet pressure and inlet temperature. Typically, the inlet pressure to the first gas/liquid separator 2 will be between 10 and 80 bar, and the temperature will usually between 0 and −60° C.

In the first gas/liquid separator 2, the feed stream 10 is separated into a gaseous overhead stream 20 (removed at first outlet 22) and a bottom stream 30 (removed at second outlet 23). The overhead stream 20 is enriched in methane (and usually also ethane) relative to the feed stream 10.

The gaseous stream 20 removed at the first outlet 22 of the separator 2 is expanded in expander 4 and subsequently fed as stream 40 into the second gas/liquid separator 3 at a first feeding point 33. Usually the second gas/liquid separator 3 is an absorber column.

The bottom stream 30 of the first gas/liquid separator 2 is generally liquid and usually contains some components that are freezable when they would be brought to a temperature at which methane is liquefied. The bottom stream 30 may also contain hydrocarbons that can be separately processed to form liquefied petroleum gas (LPG) products. The stream 30 is fed into the second gas/liquid separator 3 at the second feeding point 34, the second feeding point 34 generally being at a lower level than the first feeding point 33.

From the top of the second gas/liquid separator 3, at first outlet 31, a gaseous overhead stream 50 is removed and passed to compressor train 6.

From the bottom of the second gas/liquid separator 3, at second outlet 32, a liquid stream 60 is removed and passed to a fractionation column 5 for feeding thereto at first feeding point 53. Preferably, the fractionation column 5 is operated at an equal or higher pressure than the absorber column 3.

In the compressor 6 a compression takes place thereby obtaining compressed stream 70; typically compressed stream 70 has a pressure from 50 bar to 95 bar, preferably above 60 bar, more preferably above 70 bar. One (or more) of the compressors used for obtaining the stream 70 may be functionally coupled to the expander 4 (as is shown in FIG. 1). Compressed stream 70 is subsequently cooled in cooler 7 (such as an air or water cooler or a heat exchanger in which an external refrigerant is cycled) thereby obtaining a cooled compressed stream 80 that is subsequently heat exchanged against a stream being downstream of the first gas/liquid separator 2 and upstream of the fractionation column 5, i.e. between second outlet 23 of first gas/liquid separator 2 and first feeding point 53 of the fractionation column 5.

In the embodiment according to FIG. 1, the cooled compressed stream 80 is heat exchanged against the liquid stream 60 removed from the second gas/liquid separator 3 and subsequently passed as stream 180 to a liquefaction unit (generally indicated by reference number 16) to obtain a liquefied stream 190 such as LNG. To this end the liquefaction unit 16 comprises at least one main cryogenic heat exchanger (not shown). As the person skilled in the art will readily understand how this liquefaction may take place, this is not further discussed here.

As shown in FIG. 1, the liquid stream 60 removed at second outlet 32 of the second gas/liquid separator 3 and pumped as stream 90 to the first heat exchanger 8 for heat exchanging against the cooled compressed stream 80 after which it is fed to the fractionation column 5 as stream 110 at first feeding point 53. In the embodiment shown in FIG. 1, a part of the stream 90 (viz. stream 90*a*) is passed to a further heat exchanger ('second heat exchanger 9') before entering the first heat exchanger 8.

From the top of the fractionation column 5 a gaseous stream 130 is removed (at first outlet 51) that is heat exchanged against stream 90 a in the second heat exchanger 9 and subsequently passed as stream 140 to a drum 18. From drum 18 the top portion (stream 150) is passed to a heat exchanger 14 (for heat exchanging against stream 50) and subsequently fed as stream 160 into second gas/liquid separator 3 at third feeding point 35 that is generally at a higher point than first feeding point 33. Further, from drum 18 a bottom stream 170 is removed and rejected as e.g. a fuel stream. If desired, stream 170 can be heat exchanged in heat exchangers 11 and 12. A part of the stream 170 may be fed as stream 170*a* to the fractionation column at second feeding point 54, being generally at a higher point than the first feeding point 53. Furthermore, a reboiler 17 may be present to recycle stream 200 as stream 210 to the fractionation column 5 at third feeding point 55.

From the bottom of the fractionation column 5 a liquid stream 120 is removed (at second outlet 52) that can be further processed to obtain specific components therefrom.

As shown in the embodiment of FIG. 1, to obtain the partly condensed feed stream 10, it may have been precooled in several ways, for example by heat exchanging in heat exchangers 12, 13 and 11 as streams 10*c*, 10*b* and 10*a* respectively. In heat exchangers 11 and 12 the feed stream is heat exchanged (as streams 10*a* and 10*c*) against the top stream 50 removed from the first outlet 31 of the second gas/liquid separator 3 being passed to the compressor 6. In heat exchanger 13, the feed stream 10 is heat exchanged as stream 10*b* against an external refrigerant, e.g. being cycled in a propane ("C3") refrigerant circuit.

Further it is shown in FIG. 1 that the top stream 50 is heat exchanged (against stream 150 being the overhead stream removed from the drum 18) in heat exchanger 14, before the heat exchanging in heat exchangers 11 and 12.

If desired the feed stream 10 may have been further pre-treated before it is fed to the first gas/liquid separator 2. As an example, $CO_2$, $H_2S$ and hydrocarbon components having the molecular weight of pentane or higher may also at least partially have been removed from the feed stream 10 before entering the separator 2.

Further, the cooled compressed stream 80 may have been further cooled before it is being heat exchanged in first heat exchanger 8 against stream 90. To this end, FIG. 1 shows three heat exchangers 15*a*, 15*b* and 15*c* upstream of the liquefaction unit 16 in which one or more external refrigerants (in this case propane; "C3") may be cycled. After being cooled in heat exchangers 15*a* and 15*b* stream 80 is heat exchanged (as stream 80*b*) in first heat exchanger 8, after which it is further cooled as stream 80*c* in heat exchanger 15*c* to obtain stream 180. Typically stream 80*c* has a temperature below 0° C. and preferably above −35° C. If desired, the stream 180 may be subjected to further process steps before liquefaction takes place in the liquefaction unit 16.

FIG. 2 schematically shows an alternative embodiment according the present invention, wherein the cooled compressed stream 80 is heat exchanged against at least a part (stream 40*a*) of the expanded stream 40 obtained from the expander 4. In the embodiment shown in FIG. 2 the expanded stream 40 is split into substreams 40*a* and 40*b*, wherein stream 40*b* bypasses the first heat exchanger 8.

It goes without saying that the embodiments of FIGS. 1 and 2 can be combined, if desired.

Tables I and II give an overview of the pressures and temperatures of a stream at various parts in example processes of FIG. 1. Also the mol % of methane is indicated. The feed stream in line 10 of FIG. 1 comprised approximately the following composition: 91% methane, 4% ethane, 3% propane, almost 2% butanes and pentane and 0.1% $N_2$. Other components such as $H_2S$, $CO_2$ and $H_2O$ were previously removed.

TABLE I

| Line | Pressure (bar) | Temperature (° C.) | Mol % methane |
|---|---|---|---|
| 10c | 57.7 | 19.8 | 90.6 |
| 10b | 57.5 | −1.3 | 90.6 |
| 10a | 57.2 | −11.5 | 90.6 |
| 10 | 57.0 | −33.4 | 90.6 |
| 20 | 56.9 | −33.4 | 93.5 |
| 30 | 56.9 | −33.5 | 48.6 |
| 40 | 22.0 | −75.4 | 93.5 |
| 50 | 21.7 | −79.8 | 94.9 |
| 60 | 21.9 | −68.3 | 34.3 |
| 70 | 73.0 | 89.4 | 93.9 |
| 80 | 72.7 | 53.0 | 93.9 |
| 80a | 72.4 | 21.0 | 93.9 |
| 80b | 72.0 | −11.5 | 93.9 |
| 80c | 71.8 | −27.3 | 93.9 |
| 90 | 24.0 | −68.2 | 34.3 |
| 130 | 22.4 | 2.7 | 52.7 |
| 140 | 22.2 | −76.8 | 52.7 |
| 180 | 71.4 | −27.5 | 93.9 |

As a comparison the same line-up as FIG. 1 was used, but—in contrast to the present invention—no heat exchanging of the cooled compressed stream 80 against a stream being downstream of the first gas/liquid separator 2 and upstream of the fractionation column 5 (in particular no heat exchange against the liquid stream 60 removed form the second gas/liquid separator 3) took place.

As shown in Table II the present invention results in an increased LNG production of 2.83% when compared with the Comparison while using the same available external cooling duty.

TABLE II

| | FIG. 1 (Invention) | FIG. 1 without heat exchanging (Comparison) |
|---|---|---|
| LNG flow rate (1000 ton LNG per day) | 22.9 | 22.2 |
| Specific power (kW per ton LNG per day) | 15.2 | 15.6 |
| Increase in LNG production (%) | 2.83 | — |

The person skilled in the art will readily understand that many modifications may be made without departing from the scope of the invention. As an example, each heat exchanger may comprise a train of heat exchangers.

What is claimed is:

1. A method of liquefying a hydrocarbon stream, the method at least comprising the steps of:

(a) supplying a partly condensed hydrocarbon feed stream to a first gas/liquid separator;

(b) separating the feed stream in the first gas/liquid separator into a gaseous stream and a liquid stream;

(c) expanding the gaseous stream obtained in step (b) thereby obtaining an expanded stream and feeding said expanded stream into a second gas/liquid separator at a first feeding point;

(d) feeding the liquid stream obtained in step (b) into the second gas/liquid separator at a second feeding point;

(e) removing from the bottom of the second gas/liquid separator a liquid stream and feeding said liquid stream into a fractionation column;

(f) removing from the top of the second gas/liquid separator a gaseous stream and passing the gaseous stream to a compressor thereby obtaining a compressed stream having a pressure above 50 bar;

(g) cooling the compressed stream obtained in step (f) thereby obtaining a cooled compressed stream;

(h) further cooling the cooled compressed stream by heat exchanging the cooled compressed stream obtained in step (g) against a stream being downstream of the first gas/liquid separator and upstream of the fractionation column; and (i) liquefying the cooled compressed stream, after heat exchanging in step (h), thereby obtaining a liquefied stream.

2. The method according to claim 1, wherein in step (h) the cooled compressed stream is heat exchanged against the liquid stream removed in step (e) from the second gas/liquid separator.

3. The method according to claim 1, wherein in step (h) the cooled compressed stream is heat exchanged against at least a part of the expanded stream obtained in step (c).

4. The method according to claim 1, wherein from the top of the fractionation column a gaseous stream is removed that is heat exchanged against at least a part of the liquid stream from the second gas/liquid separator.

5. The method according to claim 1, wherein the gaseous stream removed in step (f) from the top of the second gas/liquid separator is heat exchanged against the feed stream, before the gaseous stream is fed to the compressor.

6. The method according to claim 5, wherein the gaseous stream removed from the fractionation column, after heat exchanging against at least a part of the liquid stream from the second gas/liquid separator, is heat exchanged against the gaseous stream removed from the second gas/liquid separator.

7. The method according to claim 1, wherein the hydrocarbon stream is a natural gas stream.

8. The method according to claim 1, wherein the heat exchanging in step (h) is directly heat exchanging.

9. The method according to claim 2, wherein in step (h) the cooled compressed stream is heat exchanged against at least a part of the expanded stream obtained in step (c).

10. The method according to claim 2, wherein from the top of the fractionation column a gaseous stream is removed that is heat exchanged against at least a part of the liquid stream from the second gas/liquid separator.

11. The method according to claim 3, wherein from the top of the fractionation column a gaseous stream is removed that is heat exchanged against at least a part of the bottom stream from the second gas/liquid separator.

12. The method according to claim 2, wherein the gaseous stream removed in step (f) from the top of the second gas/liquid separator is heat exchanged against the feed stream, before said gaseous stream is fed to the compressor.

13. The method according to claim 3, wherein the gaseous stream removed in step (f) from the top of the second gas/liquid separator is heat exchanged against the feed stream, before it is fed to the compressor.

14. The method according to claim 4, wherein the gaseous stream removed from the fractionation column, after heat exchanging against at least a part of the liquid stream from the second gas/liquid separator, is heat exchanged against the gaseous stream removed from the second gas/liquid separator.

* * * * *